US009842580B1

(12) United States Patent
Krasnov

(10) Patent No.: US 9,842,580 B1
(45) Date of Patent: Dec. 12, 2017

(54) HUMBUCKER PICKUP DEVICE FOR ACTIVE AND PASSIVE GUITARS

(71) Applicant: Valerii Vladislavovich Krasnov, Murmansk (RU)

(72) Inventor: Valerii Vladislavovich Krasnov, Murmansk (RU)

( * ) Notice: Subject to any disclaimer, the term of this patent is extended or adjusted under 35 U.S.C. 154(b) by 0 days.

(21) Appl. No.: 15/338,511

(22) Filed: Oct. 31, 2016

(51) Int. Cl.
*G10H 3/14* (2006.01)
*G10H 3/18* (2006.01)

(52) U.S. Cl.
CPC ..... *G10H 3/182* (2013.01); *G10H 3/181* (2013.01); *G10H 3/186* (2013.01); *G10H 2220/515* (2013.01); *G10H 2220/565* (2013.01)

(58) Field of Classification Search
CPC ..... G10H 3/182; G10H 3/181; G10H 3/186; G10H 2220/515; G10H 2220/565
USPC ..... 84/726–728
See application file for complete search history.

(56) References Cited

U.S. PATENT DOCUMENTS 3,571,483 A * 3/1971 Davidson ..... G10H 3/181 84/726
4,283,982 A * 8/1981 Armstrong ..... G10H 3/182 84/728
5,189,241 A * 2/1993 Nakamura ..... G10H 3/181 84/728
5,399,802 A * 3/1995 Blucher ..... G10H 3/181 84/726
5,525,750 A 6/1996 Beller
5,908,998 A * 6/1999 Blucher ..... G10H 3/181 84/723
6,846,981 B2 1/2005 Devers
7,166,794 B2 1/2007 Juszkiewicz et al.
2014/0318350 A1* 10/2014 Krasnov ..... G10H 3/143 84/726
2015/0262568 A1 9/2015 Krasnov

OTHER PUBLICATIONS

Kolpakov, Vladimir: Sound pickups and their basic properties. A site Guitar.ru , Information for musicians, Russia, Apr. 10, 2003, 5th indent after Figure 8 with Side-by side Humbucker picture [online]. Retrieved from the Internet <URL: http://guitar.ru/articles/pickup/sound-pickup_317.html>.

* cited by examiner

*Primary Examiner* — Jeffrey Donels

(57) ABSTRACT

A humbucker pickup device for active and passive guitars including a matched pair of elongated coil assemblies with two sets of ferrous pole pieces also includes two elongated, transversely polarized permanent magnets positioned between and parallel to the coils. The magnets are beside each other with opposite poles facing each other. The magnets and said two sets of pole pieces create two narrow magnetic fields under each string to interact with it at two points. The humbucker device includes an improved differential amplifier built from two or three operational amplifiers. Alternatively, the device may include a steel plate positioned between the magnets and extending to the strings for weakening a wide magnetic field between pole pieces of the different sets. Both embodiments, with and without the plate, are described.

8 Claims, 5 Drawing Sheets

HUMBUCKER PICKUP DEVICE FOR ACTIVE AND PASSIVE GUITARS

CROSS-REFERENCE TO RELATED APPLICATION

Not applicable.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to electromagnetic pickups for guitars and, more particularly, to an improved humbucker device which is particularly useful in guitars with active electronics. The pickup may also be used in traditional passive electric and bass guitars or other stringed musical instruments.

2. Background Art

One common and well-known flaw of conventional two-coil humbucker pickups (i.e. conventional humbuckers) is that conventional humbuckers cannot achieve the tonal characteristics in the guitar sound of conventional single-coil pickups. The sound of guitars with single-coil pickups is usually brighter and clearer than that of humbucker guitars. The main reason of that lies in the different widths of the magnetic fields from the pickups applied to the strings.

There is also another factor influencing the tonal properties of pickups. Having two coils and two row of pole pieces (i.e. two pole pieces for each string) humbuckers pick up, thus, two signals from two points of the string which are mixed thereafter. As a result, there can always be some attenuation and distortion for frequencies with different phases due to mixing the signals into humbucker. However, it appears that a magnetic factor, the negative impact of the magnetic field of pickups on the ferromagnetic strings, can be the main reason as regards the different tonal properties between humbuckers and single-coil pickups.

Conventional single-coil pickups are narrower than the conventional two-coil humbuckers approximately twice the length due to their single coil and one row of steel pole pieces. The upper end of each pole piece is directed to a respective string. Unlike the wide humbuckers, thanks to one row of pole pieces, the single-coil pickups provide a narrower magnetic field applied to one small part of a vibrating string. Such magnetic field inhibits the string vibrations to a lesser extent. Thanks to this fact, the single-coil pickups provide enough a nice natural sound for electric guitars that allows these pickups, despite their bad noise immunity, to compete successfully with the humbuckers. The single-coil pickups often include a single magnet.

In turn, conventional humbuckers also include a single magnet, but as said they have two rows of pole pieces (see FIG. 1) to provide magnetic fields applied to two points of the string by means of two pole pieces extending closely to this string. But, in fact, there is one total magnetic field within and outside of the interval between these points along the string (see FIG. 1B, the distance A). An affected portion of the string from such a wide magnetic field is significantly larger than that an affected portion of the string for conventional single-coil pickups (compare with FIG. 2). As a result, the vibrations of the strings are subjected to a large negative affect because of the wide and strong magnetic field of the humbuckers.

Ultimately, the conventional humbuckers do not provide a great advantage in sound, as it should be, with picking the vibrations up in the two points of string. Many useful harmonics of the vibrations are lost or significantly distorted in the output signal of the humbuckers. And because of this general flaw they often lose to the single-coil pickups in regards to the clarity and clearness in the sound.

Aspiring to correct the flaw of conventional humbuckers, different companies making guitars and pickups have created various versions of humbuckers. Recently, however, even despite the good noise immunity of the humbuckers, some guitar manufacturers have recognized that conventional guitar pickups, humbuckers and single-coil pickups, are still imperfect from the point of view of modern technologies of sound recording and transfer. In this regard, some companies have developed digital guitars and special pickups for them now. As a rule, such developments include the steps of inserting and mounting special digital guitar processing circuits inside the guitars. These circuits generate one or more digital string signals from analog string signals, format these digital signals and thereby help the guitars with traditional analog output to be also compatible with a digital communication protocol for output digital audio signals. Many guitar musicians prefer to record their guitars within their home studios built on the basis of modern computers. In turn, the traditional method of recording guitars in studios includes microphones and special guitar amplifiers with speaker cabinets that are very inconvenient at home.

Some companies have chosen simpler way to improve conventional analog guitars without any digital circuits or additional complexity inside the guitars. These companies make special humbucker pickup devices including preamplifiers built on well-known circuits, known as differential amplifiers using two differential inputs at connection. By virtue of the two differential inputs, a balanced input mode can be provided when the inputs are connected respectively to the two coils of a conventional humbucker. Usually these preamplifiers are mounted into the humbucker case and such humbucker devices are often called active pickups.

One of the advantages, the differential amplifiers have the standard unbalanced output that is convenient for connection with the volume-tone section inside an electric guitar. Such output may be connected to a volume potentiometer or to the switch of pickups depending on the model of the guitar. The differential amplifiers and the balanced input mode are successfully used in various professional audio devices and studio equipment such as microphone preamplifiers, mixer consoles and others, where the balanced input mode provides a full-fledged and noiseless analog audio signal.

However, in regards to guitar pickups, there is a serious problem. All known methods of connecting these pickups to preamplifiers, including the differential amplifiers in the balanced input mode, cause significant difficulties. These difficulties occur, in particular, due to the values of the conventional pickup's electrical parameters such as inductance, resistance and capacitance being too large. There arises a system of a pickup and a preamplifier as a Low-Pass filter (LP filter) having too low a cut-off frequency, about from 300 up to 1000 Hz depending on the pickup model. This is certainly not acceptable for a good guitar sound. Another issue associated with the use of magnets in the conventional pickups is in using these pickups in an active mode such as jointly with a preamplifier.

Modern passive pickups include magnets of large force which highlights the mentioned flaw of the conventional humbuckers in regards to the losses and distortions in the output signal. Moreover, the differential amplifiers emphasize this flaw even more, when used jointly with the humbuckers especially when the balanced input mode is used. In this case, additional filters or equalizers are needed inside the body of the humbuckers or guitar that complicates the design of pickups and the guitar, but does not provide an increase in benefit for the guitar sound. A similar situation remains also for conventional single-coil pickups despite their narrower magnetic field. It is quite difficult and often impossible to use the differential amplifiers and the balanced input mode directly with the conventional humbuckers.

Therefore the companies specializing in the production of active humbuckers usually use weak magnets and make special coils of copper wire with a small number of turns (less inductance, resistance and capacitance) to increase the cut-off frequency of the said LP filter in the system of a humbucker and its preamplifier. A weak initial signal from such coils and a weak magnet is amplified to the needed value by the preamplifier mounted into the humbucker or guitar.

Such active pickups, however, have limited use. Despite the amplified signal, the guitar musicians often do not like the sound of these pickups and any other sound produced from coils with a too small number of turns. Such sound is described as plastic, "no brisk", or not natural enough. Moreover, there is a tendency among guitarists to look for and order special pickups with a larger number of turns in coils than that in conventional coils of the conventional passive pickups. For example, these are single-coil pickups roughly with 10000 turns (P-90 pickups) instead of 6000-7000 turns in other versions of single-coil pickups. Despite the bad noise immunity the P-90 pickups are very popular among guitar players thanks to their rich and saturated sound.

Typical values of the number of turns in conventional (passive) humbuckers for each coil may be 4500 turns (Neck humbucker) and 5000 turns (Bridge humbucker). The difference in the numbers is necessary due to the fact that a conventional humbucker in the Bridge position on a guitar gives a little less output signal than the same humbucker in the Neck position. Therefore, to level the signals of both pickups relative to each other, the coils of the Bridge humbucker have the larger number of turns, i.e. 5000. Single-coil pickups include coils with the number of turns of about 6000 and more, and for certain pickups this number, as mentioned above, may be up to 9000 turns and more.

There have been attempts from various inventors and pickup manufacturers to eliminate the flaw common to the conventional humbuckers and to get more uniform harmonic spectrum like that in single-coil pickups. One of the attempts, for example, is the pickup known as a Side-by-side humbucker. This, in fact, is a narrow humbucker having a peculiar sound. The affected portion on a string from the magnetic field of such narrow pickups become less, but this is only a partial solution of the problem. Two points on the string, from where the vibrations are picked up, are too close to each other, with similar harmonics and as before, this portion of the string is in the zone of the total and strong magnetic field. The sound of the Side-by-side humbucker is sometimes poorer than that from a conventional wide humbucker.

Another humbucker version, a Hum-canceller pickup known as double-coil pickup, is compacted into the size of a single coil. It also has two windings for noise immunity as any conventional humbucker, but its windings have one common row of pole pieces. Thus, the useful signal of the Hum-canceller is picked up only from one point on the string as in single-coil pickups.

All the described pickups only come near to conventional single-coil pickups in regards to the width of the magnetic field applied to a string. The most successful of them are the said Hum-cancellers, which pick up the electromagnetic signal from one point on the string (as that in the single-coil pickups). However the sound of the described pickups is not like that of the familiar and popular sound of conventional, wide humbuckers with their signals from the two points on the string.

The differential amplifiers with their balanced input mode significantly highlight any damage or flaw in the harmonic spectrum of the output signal for any conventional guitar pickup with any active mode. And this is so even for the conventional single-coil pickups, for which the width of the magnetic field applied to the string is also not narrow enough to provide the active mode with high quality and efficiency. Probably because of that, some guitar companies began to create complicated designs in direction of digital guitars with special pickups for them. Moreover, the said negative magnetic effect of a conventional pickup is further enhanced with two or more pickups on a guitar, and losses and distortions among harmonics in the guitar output are additionally increased.

As can be seen, there is a need for a humbucker pickup device that may remain the same wide size as a conventional humbucker and with conventional coils that may provide excellent results in sound without the common flaws of the conventional humbuckers. The sound of the device may greatly exceed the sound of the conventional humbuckers and even the single-coil pickups as regards the clarity and clearness. This is especially true when the device may be used in an active mode, in accordance with which the humbucker pickup device may also include a preamplifier connected to its two coils in the balanced input mode. In this regard, it becomes possible to get quite a natural and beautiful sound of a guitar and a quality signal for recording the guitar even by usual home HI-FI preamplifiers and computers without any microphones, special guitar amplifiers and loudspeakers. The creation of digital guitars may not be such a viable solution.

SUMMARY OF THE INVENTION

In one aspect of the present invention, a humbucker pickup device for active and passive guitars comprises: a first magnet and a second magnet positioned besides the first magnet, wherein opposite poles of the first magnet and the second magnet face each other; and a first set of pole pieces positioned along an outer pole of the first magnet and a second set of pole pieces positioned along an outer pole of the second magnet, wherein in the first set of pole pieces each of the pole pieces creates for the corresponding string a narrow and useful first magnetic field between an upper end and a lower end of this pole piece and, respectively, in the second set of pole pieces each of them creates a narrow and useful second magnetic field for the string. The distance between the first set of pole pieces and the second set of pole pieces is an interval D, wherein the first set and the second set of pole pieces, the first magnet and the second magnet may create an unwanted third wide magnetic field beneath each string between two corresponding pole pieces, wherein one pole piece of the first set and the second pole piece of the second set. Thanks to the two magnets the wide magnetic field is significantly weaker around string vibrations than in the case of single magnet and its negative magnetic effect to the string may be neglected.

In another aspect of the present invention, a humbucker pickup device for active and passive guitars comprises: a first magnet and a second magnet positioned besides the first magnet, wherein the opposite poles of the first magnet and the second magnet face each other; a plate positioned between the first magnet and the second magnet, wherein the plate being a pole piece additionally weakens the wide magnetic field between the first set and the second set of pole pieces so that the part of the field (a line 9 of the FIG. 4B) is localized beneath the strings outside the vibrations; a first set of pole pieces positioned along an outer pole of the first magnet and a second set of pole pieces positioned along an outer pole of the second magnet, wherein in the first set of pole pieces each of the pole pieces creates for the corresponding string a narrow and useful first magnetic field between an upper end and a lower end of this pole piece and, respectively, in the second set of pole pieces each of them creates a narrow and useful second magnetic field; and a first coil and a second coil as a matched pair, wherein the first coil attaches to the first magnet and around the first set of pole pieces and the second coil attaches to the second magnet and around the second set of pole pieces, wherein the interval D is also the distance between a center of the first coil and a center of the second coil.

In another aspect of the present invention, a method for improving the narrowing of the magnetic field applied to the strings from a humbucker pickup device comprises: placing at least one humbucker pickup device underneath a set of strings on a stringed instrument, wherein the humbucker pickup device is defined by a first magnet and a second magnet positioned besides the first magnet, wherein opposite poles of the first magnet and the second magnet face each other; and a first set of pole pieces positioned along an outer pole of the first magnet and a second set of pole pieces positioned along an outer pole of the second magnet, wherein in the first set of pole pieces each of the pole pieces creates for the corresponding string a narrow first magnetic field between an upper end and a lower end of this pole piece, and, respectively, in the second set of pole pieces each of them creates a narrow second magnetic field for the same string; a first coil and a second coil as a matched pair, wherein the first coil attaches to the first magnet and around the first set of pole pieces and the second coil attaches to the second magnet and around the second set of pole pieces, wherein the interval D is the distance between a center of the first coil and a center of the second coil; and generating electromagnetic signals by having the first narrow magnetic field and the second narrow magnetic field interact with the string.

These and other features, aspects and advantages of the present invention will more fully disclosed in embodiment for active pickups, where thanks to the invention it becomes possible to use magnets of any big force and coils with a large number of turns without the use of filters or equalizers inside the pickups or guitar body.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a humbucker pickup device for active and passive guitars that may include two magnets positioned besides each other. Opposite poles of the first magnet and the second magnet may face each other and for convenience referred to hereinafter as internal poles of the magnets. For both the active and the passive modes of the invention two coils may be used with, but not limited to, any conventional number of turns. The coils may be substantially identical as a matched pair. A first set of pole pieces may be positioned along an outer pole of the first magnet and a second set of pole pieces may be positioned along an outer pole of the second magnet. The set of pole pieces and the two magnets may create several magnetic fields beneath each string, two of which are uniquely narrow and useful magnetic fields applied to the string. More specifically, each pair of pole pieces, one of which relates to the first magnet, and another to the second, creates beneath a respective string: a first useful magnetic field between an upper end and a lower end of a pole piece of the first magnet, a second useful magnetic field between an upper end and a lower end of a pole piece of the second magnet. The first magnet and the second magnet may be positioned within an interval D, wherein the same pair of the pole pieces (beneath the same string) may create an additional third wide magnetic field extending along the string between the upper ends of these pole pieces. As a new rule that was checked by means of a test with 3 guitars described below, with two magnets positioned within the interval D the third magnetic field is significantly weakened. The said test has showed an interesting fact that with the two magnets the wide magnetic field, which is unwanted in the interval D around the string, becomes weak so that its negative magnetic effect to the string vibrations may be neglected. Respectively, the frequencies and harmonics of the vibrations with wavelengths and half-waves getting to this interval do not undergo appreciable losses and distortions. As a result, the humbucker pickup device provides an output signal enriched with new and natural harmonics which, in turn, is absent in conventional humbuckers with a single magnet. This advantage of the two magnets is particularly noticeable in the active mode with the use of differential amplifiers, in particular, connected to humbucker coils in a balanced input mode.

Figure 3A:
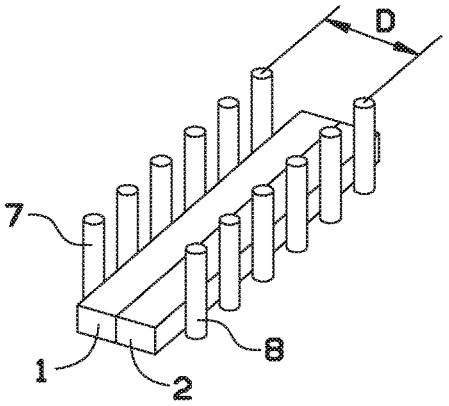
FIG. 3A is a perspective view of an exemplary embodiment of the present invention showing a magnetic system of it.

As is illustrated in FIGS. 3A through 8, the humbucker pickup device for passive and active guitars may include a pair of identical transversely polarized permanent magnets 1 and 2. These magnets include a first magnet 1 and a second magnet 2 as is shown in FIGS. 3A, 3B, 4A, 4B. The magnets 1, 2 may be ceramic or of other magnetic material. The magnets may be of any force, but their forces must be substantially equal to each other as well as their geometrical sizes. In certain embodiments, each of the magnets 1, 2 may be a rectangular bar with a cross-section of approximately 7×7 mm and with a length of not less than approximately 50 mm. FIGS. 3A, 3B illustrate an exemplary embodiment of the present invention.

Figure 3B:
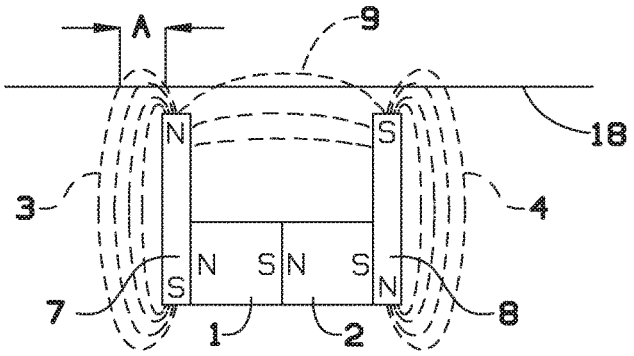
FIG. 3B is an elevation view of an exemplary embodiment of the magnetic system of the humbucker pickup of FIG. 3A showing the interaction of the magnetic field with the strings above it.
Figure 4A:
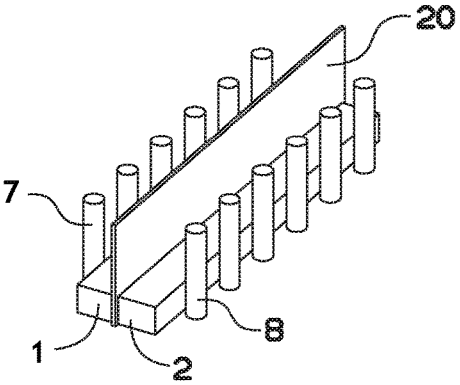
FIG. 4A is a perspective view of an alternate embodiment of the present invention showing a magnetic system of it.
Figure 4B:
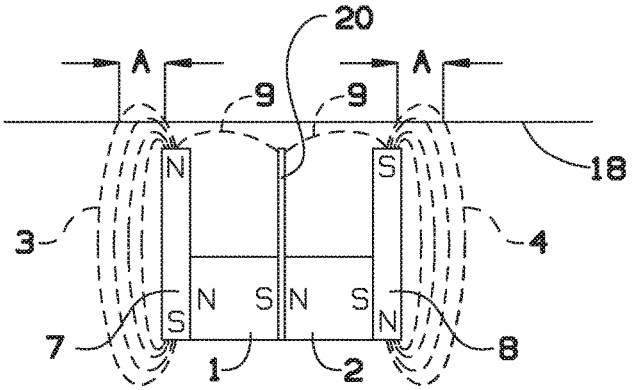
FIG. 4B is an elevation view of an alternate embodiment of the magnetic system of the humbucker pickup of FIG. 4A showing the interaction of the magnetic field with the strings above it.

In certain embodiments, a plate 20 may be placed in between the magnets 1, 2 as is shown in FIGS. 4A, 4B. The plate 20 must be made of soft iron, steel, or the like, with a thickness of approximately 0.5-1.0 mm. The plate 20 length may be not less than the length of the magnets 1, 2, and the plate 20 height must be about the same as that for a first set of pole pieces and a second set of pole pieces. Two pole pieces 7, 8 from these different sets may form a pair of pole pieces beneath a respective string 18 as indicated. The first set of pole pieces and the second set of pole pieces may be positioned along outer poles of the magnets 1, 2 respectively and, also, may be within the distance between a first coil L1 and a second coil L2. The coils L1, L2 are not shown in FIGS. 3A, 3B, 4A and 4B for clarity. All pole pieces may be any type such as poles, bars, screws or a rail instead of a set of pole pieces (as in rails humbuckers) and the like and they must be made from soft iron, steel or the like.

As is shown in FIG. 3B, the outer poles of the magnets 1, 2, the opposite N (North) and S (South), induce opposite poles on the pole pieces 7, 8. In turn, opposite poles arise also on the upper and lower ends of each of the pole pieces 7, 8. Under a string 18, the first pole piece 7 creates a first outside magnetic field 3, and the second pole piece 8 creates a second outside magnetic field 4, which may be the main useful magnetic fields interacting with the string 18. These useful magnetic fields include the magnetic field 3 between the upper and lower ends of the pole piece 7 and the magnetic field 4 between the upper and lower ends of the pole piece 8. The string 18 may be made of steel or the like.

Further, the pole pieces 7, 8 and the magnets 1, 2 may create an additional third magnetic field under the same string 18 within an interval D being the distance between the pole pieces 7, 8 (FIG. 3B). This generated third magnetic field is quite weak due to the presence of two magnets in the interval. A part of this field may be a wide magnetic field, a line 9, extending along the string 18 between the pole pieces 7, 8. The magnetic field 9 is unwanted, but it is as residual and enough weak magnetic field around the string 18. And in the case of a single device of the present invention on a guitar, this wide magnetic field 9 can be neglected concerning its influence on the string vibrations.

Figure 1:
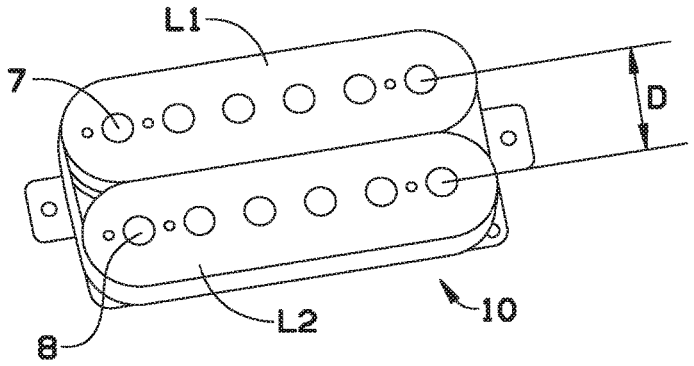
FIG. 1 (PRIOR ART)
FIG. 1 is a perspective view of a conventional two-coil humbucker pickup in its assembled configuration (prior art)
Figure 1A:
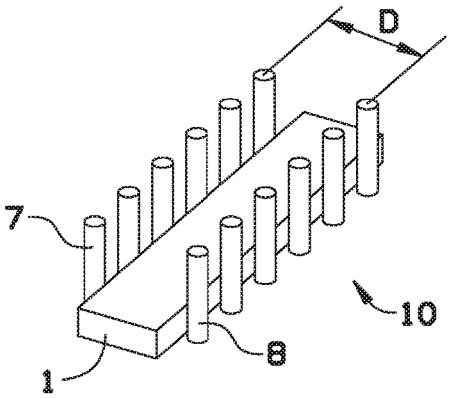
FIG. 1A (PRIOR ART)
FIG. 1A is a perspective view of a magnetic system of the conventional humbucker pickup of FIG. 1 (prior art)

The two magnets 1, 2 may be close, back to back, and mutually attracted to each other due to the opposite poles north N and south S, as shown in FIGS. 3A and 3B. These poles, named as the internal poles of the magnets, must be in the approximate center of the interval D between the first and second sets of pole pieces. The total width of the two magnets 1, 2 of FIG. 3A may be approximately the same as that one of a single magnet 1 of FIG. 1A illustrating a magnetic system of a conventional humbucker 10 (coils are not shown). The magnets 1, 2 are located in the analogous place between the lower ends of pole pieces of different sets as where the single magnet 1 is positioned in the conventional humbucker 10. Thus, the general dimensions of the humbucker pickup device may be the same as that of any conventional humbucker.

As is shown in FIG. 3B, lines of force 3, 4 and 9 indicate all magnetic fields that may emanate from the upper ends of pole pieces 7 and 8 into both sides, but only the lines of force 3 and 4 (the two useful magnetic fields) may effectively interact with the string 18 without significant negative affect on it.

The traditional method of monitoring lines of force (with the iron filings) is not able to objectively describe the magnetic field 9 between the pole pieces 7, 8 with a glance to guitar tone and guitar pickups. The diagrams with the iron filings in both cases (with a single magnet and with the two magnets) may be similar. Although if by feel, the difference between the magnetic fields 9 of the two magnets and the single one is quite obvious from a simple experiment by means of a small steel thing (a needle or a screwdriver) and fingers. It can be felt that the fingers easily hold the thing in the middle between the pole pieces 7, 8 (where their upper ends) without any effort in the case of the two magnets. For convenience, it is possible to use two steel plates instead of the pole pieces 7, 8 (similarly as in a rail humbucker). While with the single magnet the fingers hold the same thing using a pretty big effort by contrast to the two magnets.

More objective estimation regarding the magnetic field 9 in the humbucker device can be obtained by means of a test with three guitars. This test consists in that to compare on the sound the following three electric guitars: a first guitar with conventional single-coil pickups (for example, a Fender Stratocaster model), a second guitar with a conventional humbucker (with a single magnet) and a third guitar with the humbucker device of the invention, i.e., with the two magnets and with the same coils as in the conventional humbucker of the second guitar. Neck pickups of the guitars are the most suitable for the comparison. It is assumed that all the magnets in the pickups are of the same material and similar concerning their forces. The humbucker guitars (the second and the third) may be similar and be of the same model. Also, the guitars must be tested by means of the same or similar amplifier devices.

In general, testing new audio devices with the help of invited experts and musicians is the traditional practice used by manufacturers of these devices before their serial release. Similarly, it can be done in the offered method of testing the three guitars given the fact that the difference in sound between humbuckers and single-coil pickups is well known in the music world. And the first single-coil pickup guitar may be an excellent indicator when it is compared with two other humbucker guitars.

Figure 6:
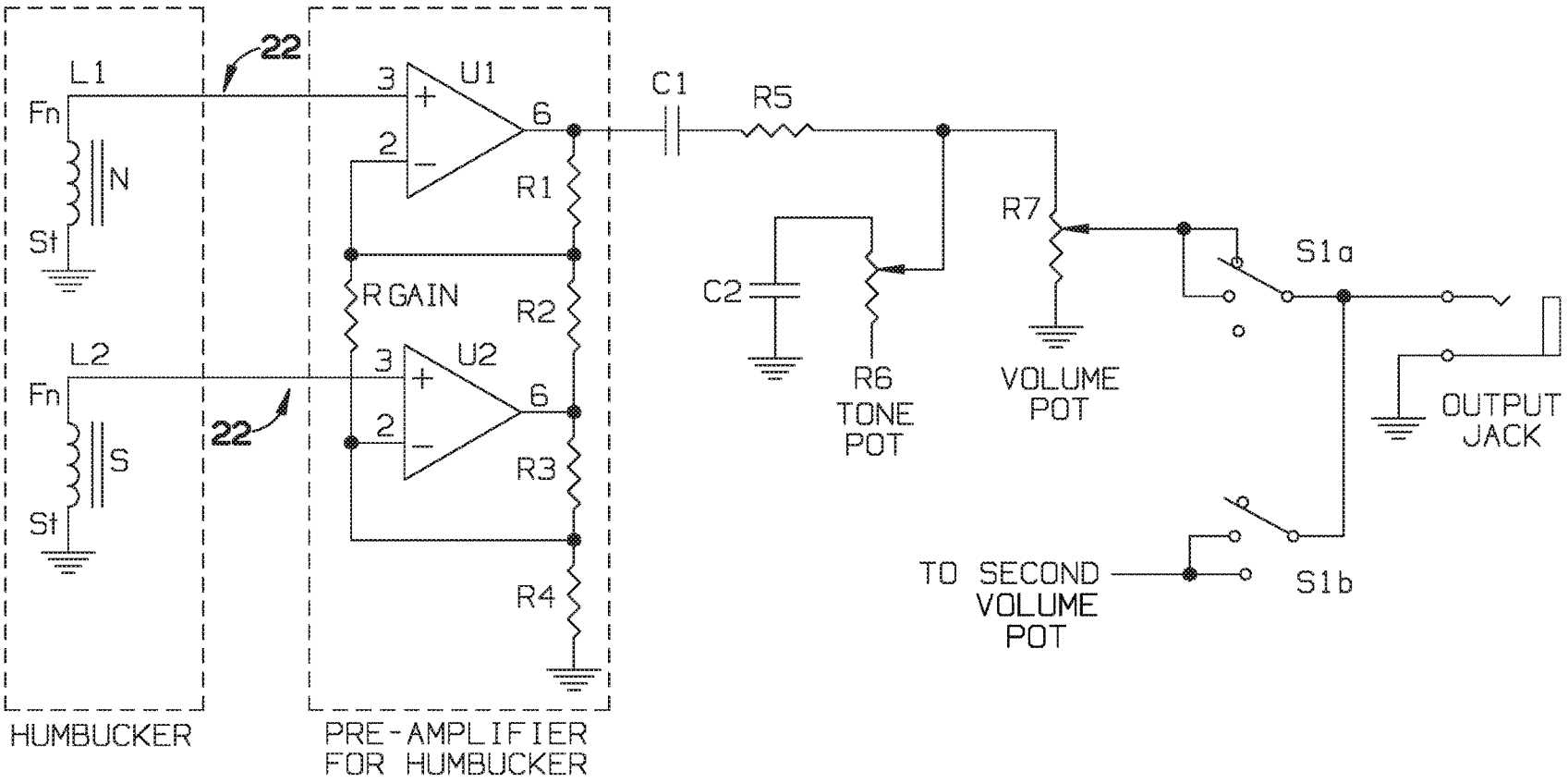
FIG. 6 is a schematic wiring diagram showing the presently preferred embodiment of the present invention in the active mode with a preamplifier inside a guitar.

To facilitate comparison it will be better to use an active balanced mode, identical in all three guitars. An active mode for any guitar pickup is like a magnifying glass, it perfectly shows any flaws or advantages in the sound from this pickup. To create identical active modes in the tested guitars three identical preamplifiers may be used, for example, made according to FIG. 6. The humbuckers (in the second and the third guitars) must be connected to their preamps so as is shown in FIG. 6, i.e., in the balanced input mode.

As for the single-coil pickup guitar, here it is desirable to install a second single-coil pickup (the same as a Neck pickup) on the Bridge position (or on the Middle). And these two pickups (Neck and Bridge) may be connected to the preamp of FIG. 6 respectively in the balanced input mode. In case of two identical single-coil pickups one of the magnets may be turned vice versa to provide the balanced mode. The amplitude of string vibrations is less in the Bridge position, i.e., the guitar tone is mainly formed from the Neck pickup. And to reduce even more the Bridge pickup influence on the tone, this pickup may be adjusted far from strings.

Further, the thus prepared three guitars may be represented in the active mode for examination to the group of musicians and guitar experts. Certainly guitarists can notice that the first guitar surpasses the second for brightness. The main reason of the advantage in brightness is complete absence of any magnetic field 9 here because the Neck and the Bridge pickups are too far from each other. However, any good expert, after all, will agree that this option, the first guitar with the active mode, is not good enough for a serial release.

The important thing of this test is the fact that the first guitar with the single-coil pickups being better than the second, however, is significantly worse than the third with the humbucker of the invention on brightness and naturalness of the guitar sound. I.e., the third guitar can be recognized as a favorite in the test and without doubt appropriate to a serial release. The described test was carried out with the pickups using standard modern ceramic magnets (strong enough).

Based on this test it is possible to draw a conclusion: the unwanted magnetic field 9 in the invention, FIG. 3B, practically is too weak. Another interesting moment, in the present invention an aperture A of the real magnetic field applied to a string is obviously less than that in the single-coil pickup of FIG. 2. Also, the test shows an interesting difference between the second and the third guitars. In the active mode the tone of the second guitar becomes worse than with the traditional passive mode. This explains why conventional pickups are practically not used with differential amplifiers (or if only with the use of special filters or equalizers). In turn, the third guitar (with the two magnets) regarding its tone, vice versa, becomes much better with the same active mode. So, to provide an active mode with the highest quality for conventional humbuckers it is necessary to install into them two magnets instead of a single. On this basis further the corresponding assumptions and calculations are made.

An affected portion A of the string 18 because of one useful magnetic field 3 of the humbucker pickup device is shown in FIG. 3B. As is seen, this portion A is substantially small. It is much smaller than the interval D between the pole pieces 7, 8. Also, the portion A from any of the two magnetic fields 3, 4 may be much smaller than a distance between them, i.e. between the two affected portions A on the string 18 (see FIG. 4B as for the two portions A). Thereby, a part of the string 18 corresponding to this distance despite close proximity to the humbucker device may be almost completely free in its vibrations from a negative influence of the magnetic fields 3, 4.

Figure 1B:
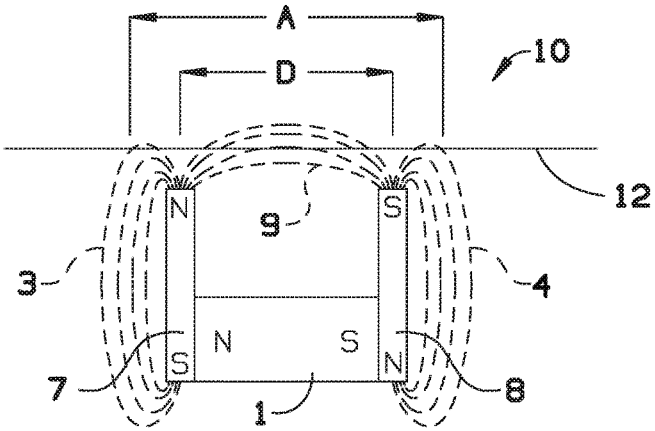
FIG. 1B (PRIOR ART)
FIG. 1B is an elevation view of the magnetic system of the conventional humbucker pickup of FIG. 1A showing the interaction of the magnetic field with the strings above it (prior art)

In turn, the wide magnetic field 9 of the conventional humbucker 10, FIG. 1B, is too strong field and it cannot be neglected. In fact, here the affected portion A of a string 12 is commensurate with the interval D and the width of the pickup.

Figure 2:
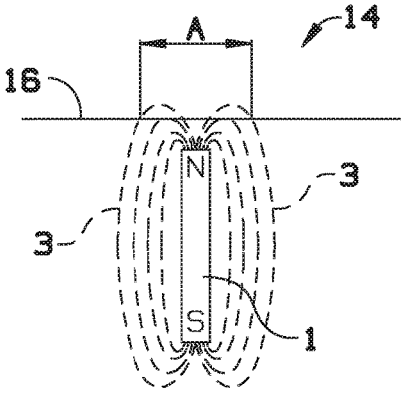
FIG. 2 (PRIOR ART)
FIG. 2 is an elevation view of a magnetic system of a conventional single-coil pickup showing the interaction of the magnetic field with the strings above it (prior art)

Also, in the case of the humbucker pickup device of FIG. 3B, the small affected portion A of the string 18 may be even smaller (more than twice) than that on a string 16 for a single-coil pickup 14 of FIG. 2 with a single set of pole pieces (a coil not shown). In particular, FIG. 2 illustrates a version of the single-coil pickup 14 with a single continuous magnet 1 instead of the single set of pole pieces.

In other words, from FIG. 3B, the width or the magnetic field aperture A applied to the string 18 belongs only to one branch, the first outside magnetic field 3, of magnetic fields emanating from the upper end of the pole piece 7. This effective aperture A may be outside of the interval D, and may be uniquely small and quite harmless to the string 18, such as a steel string or the like, not hampering its vibrations. In turn, in the conventional humbucker 10 of FIG. 1B, a wide strong magnetic field 9 is, in fact, the main magnetic field in generating the electromagnetic signals. In the conventional single-coil pickup 14 of FIG. 2, an aperture A is formed from two branches of the magnetic field 3.

The uniquely small apertures A of the magnetic fields 3, 4 (FIGS. 3B, 4B) results in the fact that string vibrations occur without any hindrance from these fields, without significant losses or distortions in the frequency spectrum, and, in fact, with new harmonics for the humbucker pickup device.

It is possible to estimate approximately a profit from such small aperture A for the harmonic spectrum of the invention output in comparison with the conventional humbucker 10 and the single-coil pickup 14. For convenience it is possible to consider that along the string 12 an aperture A of FIG. 1B (the conventional humbucker 10) is approximately equal to the interval D that for conventional humbuckers 10 is equal usually about 18 mm (though, the aperture along the string 12 may be a little more). Further also approximately, an aperture A of FIG. 2 (the single-coil pickup) is twice lesser than the interval D of FIG. 1B, i.e. 18/2=9 mm. And the smallest aperture A of FIG. 3B (the present device) may be twice as less than that one of FIG. 2, i.e. 9/2=4.5 mm. Knowing the length of a vibrating string on a guitar (about 648 mm) and based on standard calculations of physics of vibrating string it is possible to determine frequencies, wave-lengths of which (or half wave-length) become comparable with the said apertures. For example, for the sixth string, the note E (mi, 80 Hz), the said calculations may show that the values of the apertures 18, 9 and 4.5 mm correspond to harmonics with frequencies 2880 Hz, 5760 Hz and 11520 Hz. This means that losses and distortions into the harmonic spectrum for the conventional humbucker 10 of FIG. 1B may be already for frequencies from 2880 Hz and above, for the single-coil pickup, respectively, from 5760 Hz, that is a little better. The best result is 11520 Hz.

Indeed, conventional humbuckers have a well-known failure around 3000 Hz into their amplitude-frequency characteristic for the sixth string. Frequencies around 3000 Hz are the same frequencies that provide the brightness and clarity in the guitar sound and what usually does not suffice with conventional humbuckers 10. The said calculation for the failure around 2880 Hz is shown in the article of Kolpakov "Sound pickups and their basic properties", published on Apr. 10, 2003. The article is hereby incorporated by reference into this application.

The best result from the calculations means that the frequency range of the device may be without any losses and distortions in fields up to approximately 11520 Hz. This is a very good result because in the absence of pickup distortions the working range of equipment up to 10-12 kHz is desirable for any guitar including acoustic one. This result is approximate, but real proportions in the magnetic field apertures of the described pickups may be even worse for the conventional humbucker 10 than it was accepted in the calculations.

At the same time, despite the narrowing of the useful magnetic fields in the humbucker pickup and their uniquely small apertures A, the humbucker pickup output may not be less than that one for a conventional humbucker 10 with the same coils and a single magnet. i.e., the humbucker pickup may well be used in a usual passive version without any preamplifier inside the humbucker device or a guitar. In this case a first coil L1 and a second coil L2, if they are wound in the same direction, may be connected out of phase to each other (this case is not shown). The coils L1, L2 may have opposite magnetic polarities from the sets with pole pieces 7 and 8 (see FIGS. 3B, 4B), as a result, also in opposite electrical polarities the coils may provide noiseless signal as that in any conventional humbucker 10.

Figure 5:
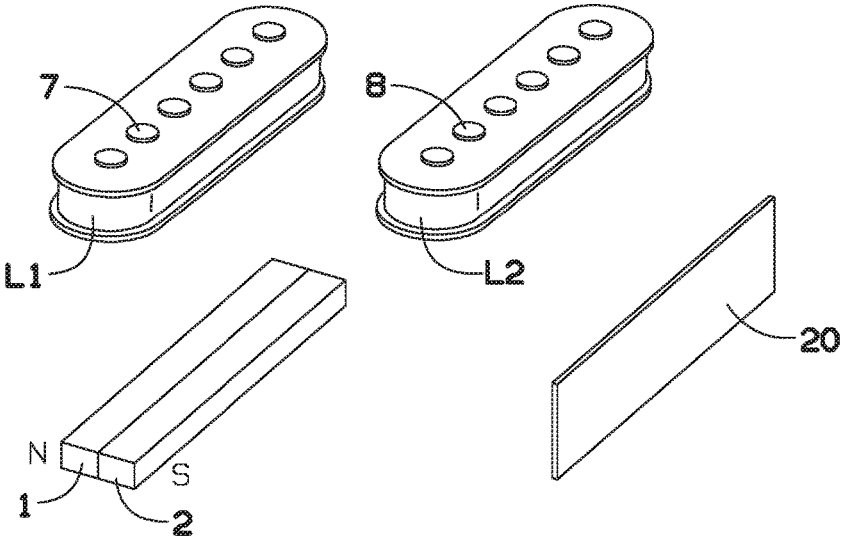
FIG. 5 is an exploded perspective view of structural components including coils of the humbucker pickup of FIGS. 3A and 4A.
Figure 5A:
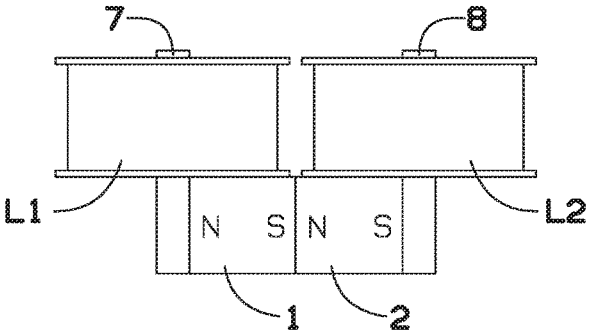
FIG. 5A is an elevation view of the humbucker pickup in its assembled configurations for an exemplary embodiment of the present invention.
Figure 5B:
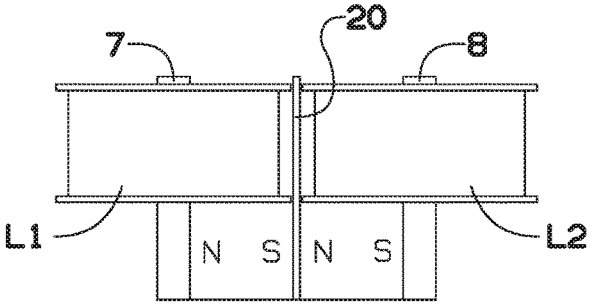
FIG. 5B is an elevation view of the humbucker pickup in its assembled configurations for an alternate embodiment of the present invention.

As mentioned, the total width of the two magnets 1, 2 (abutting each other) in the device may be approximately the same as the width of a single magnet 1 in the conventional humbucker 10. It may be desirable to fit the magnets 1,2 into the space between the two sets of pole pieces of the different coils L1,L2 (as the single magnet in conventional humbuckers 10). Owing to this, and using conventional coils L1, L2, the manufacturing technology surrounding the humbucker of the invention may allow for a similar process as with any conventional humbucker 10, thereby decreasing costs. Improving the conventional humbucker 10 may also be possible by replacing the single magnet by the two magnets 1, 2. FIGS. 5, 5A, 5B, illustrate components of the present invention (with conventional coils L1, L2) in their separated and assembled configurations for the two embodiments of the invention.

However, to get the full benefit in the guitar sound from the humbucker output enriched by the new harmonics and to use some other possibilities of the present invention, the active mode with a preamplifier may be preferred. The conventional coils L1, L2, which may have any number of turns and the magnets 1, 2 of any force, can give for the present invention a definite advantage in the manufacturing technology in comparison with traditional active pickups.

In substance, as the primary advantage of the present invention may be its ability to be effective and convenient if it is used with a preamplifier which can work in the balanced input mode with the use of a differential amplifier. Usually differential amplifiers are built from operational amplifiers by means of well-known circuits and successfully used in professional audio and studio equipment. In certain embodiments of the invention the differential amplifier may be built from one or more operational amplifiers.

An electric guitar with the humbucker device in the active mode may provide an excellent sound with natural middle frequencies and without any surplus in the low frequencies, i.e., provides an excellent balance of frequencies. This guitar sound may be quite natural, with the present invention it may be achieved easily without any additional filters or equalizers inside the guitar which, in turn, are often used in cases of conventional active pickups, active and digital guitars. The sound of the humbucker with the active mode may greatly exceed the sound of conventional (passive) humbuckers 10 and even single-coil pickups on the same guitar or any other as regards to the clarity and clearness, and may be more saturated and beautiful.

The Preamplifier and the Active Mode

In particular, a preamplifier for the invention may use improved differential amplifiers (known as instrumentation amplifiers) built from two or three operational amplifiers. One of their useful features is the fact that they have excellent high input impedance that may be useful for the invention to get the full benefit from the humbucker output enriched by the new harmonics.

FIG. 6 illustrates a preferred embodiment of the present invention with a preamplifier built from two operational amplifiers U1 and U2. As is seen, the preamplifier may be connected to two coils L1 and L2 of the humbucker pickup in the balanced input mode by two differential inputs 22 (the balanced input). In certain embodiments, the coils L1, L2 may be wound in the same direction to get the balanced input mode. Each of the inputs 22 may be connected to the end of a respective coil (finish Fn in FIG. 6), and the beginnings of both coils (start St) may be grounded. The two coils L1 and L2 have opposite magnetic polarities due to opposite poles of the pole pieces 7 and 8 (see FIGS. 3B, 4B) belonging to the different coils L1 and L2 (not shown in those Figures). Thus, two signals from the coils L1, L2 are electrically of opposite polarities as well. The preamplifier works in such a way that further, one of the signals (from the coil L2, after the operational amplifier U2 and after the resistor 2) is inverted by an inverting input 2 of the operational amplifier U1, shown in FIG. 6. Finally, both useful signals are added, and noises, which are electrically induced in the coils L1, L2, cancel each other out.

In FIG. 6 the embodiment with the preamplifier is shown with an electric guitar including two pickups with respective two volume and two tone potentiometers and a typical 3-way switch S1 of the pickups. Inside the guitar body the unbalanced, usual output of the preamplifier may be connected to a volume potentiometer R7 through a capacitor C1 and a resistor R5. The resistor R5 must be used with two or more active pickups on the guitar when mixing the signals is possible.

In certain embodiments, two humbucker devices may be used on a guitar and if both need the active mode, then a second device may have a second preamplifier of its own. Both devices and their preamplifiers may be identical. Therefore, the second device and its preamplifier are not shown. Accordingly, the output of the second preamplifier may be connected to a second volume potentiometer of the guitar in the same manner (through a capacitor and a resistor identical to C1 and R5) as in FIG. 6 for the first preamplifier. A difference may be in resistors R-GAIN of the preamplifiers, by means of which the desired output level may be set for each device on the guitar. With conventional coils an amplification factor or the gain for the preamplifiers may be within 1-3, which may allow the corresponding output signal of the electric guitar to be compatible with conventional guitar equipment such as amplifiers, effect boxes and the like.

Concerning the resistors R-GAIN, they may allow the gain of the preamplifier's output signal to be changed by changing the value of a single resistor in the preamplifier circuit. This may be convenient for any guitar if it comprises two (and more) the humbucker devices of the present invention because here there may be no need to follow the strict proportion to the number of turns between the Neck and Bridge pickups as that in conventional passive pickups. For example, with identical resistors R1=R2=R3=R4 and equaling 15K, at first in a Neck humbucker's preamplifier the resistor R-GAIN may be set and fixed within from 300K to 500K, or the resistor may not be. Next, in a Bridge humbucker's preamplifier, the analogous resistor R-GAIN may be chosen from approximately 33K to 47K or the like, to adjust and fix the outputs of both humbucker devices in accordance with each other.

Also, the resistor R-GAIN gives the chance to add in parallel to it an additional resistor to increase the gain and the level of the guitar output. This may be useful benefit in home studios when the special equipment of studio or for guitar may be absent or inconvenient, and the usual output level of an electric guitar may be insufficient to record in a home studio computer-based environment. In this case, the electric guitar body may comprise an additional 2-way toggle connecting (or disconnecting) the additional resistor to provide for the guitar an additional gain, such as an additional mode of work, for example, with the usual home HI-FI preamplifiers and others.

Referring back to the prior art, FIG. 1B, it can be noted for the conventional humbucker 10 with its flaw (as regards the losses and distortions in its harmonic spectrum) that the instrumentation amplifiers with their excellent high input impedance significantly worsen the sound of this humbucker because of its flaw. They emphasize this flaw even more, thereby, making the conventional humbucker 10 use almost impossible here in the active mode. While in case of the present invention (in the absence of the flaw), vice versa, these amplifiers (including the preamplifier of FIG. 6) highlight an excellent frequency balance and a saturation of the guitar sound comprising new useful and natural harmonics, which are very well heard. Thanks to this, the guitar sound may become quite musical and this is so, even when an electric guitar, its body, may not be of the best quality. The balanced input mode of the preamplifier of FIG. 6 may provide the same benefits as that in any other studio equipment from similar preamplifiers working in the same balanced mode. Such benefit is impossible with the conventional humbucker 10 because of its flaw, also impossible in digital guitars which may comprise conventional magnetic pickups with the same flaw requiring additional filtering circuits and equalizers inside the guitar body, and also, an additional digital output on the guitars.

A guitar (electric, bass or other) with the device and its preamplifier may also be compatible with different amplifying equipment not associated with electric guitars. In this way, the guitar may also provide an excellent full-fledged signal for recording by means of usual home HI-FI preamplifiers in home studios computer-based, wherein special guitar amplifiers with loudspeakers and microphones are inconvenient. Therefore, any analog-digital conversion inside a guitar may not be required and the problem of creating digital guitars may not be as big of a problem for manufacturers.

The Components for the Preamplifier

The preamplifier of FIG. 6 and its power supply may be built from operational amplifiers TL061 as U1, U2 and U3 (see also FIG. 7), TL062 (taking into account other leads in the chip) and other operational amplifiers, such as any conventional amplifiers used in audio devices, such as ones with a low current supply of approximately less than 3.0 mA. Resistors R1, R2, R3 and R4 may be identical and equaling within from approximately 10 k up to approximately 20 k. Resistor R5 may be from approximately 3.3 k to approximately 5.6 k, the capacitor C1 may be within from approximately 0.22 uF to approximately 1.0 uF. With the active mode, volume potentiometers on guitar (R7 in FIG. 6) may be roughly 250 k and less.

Figure 7:
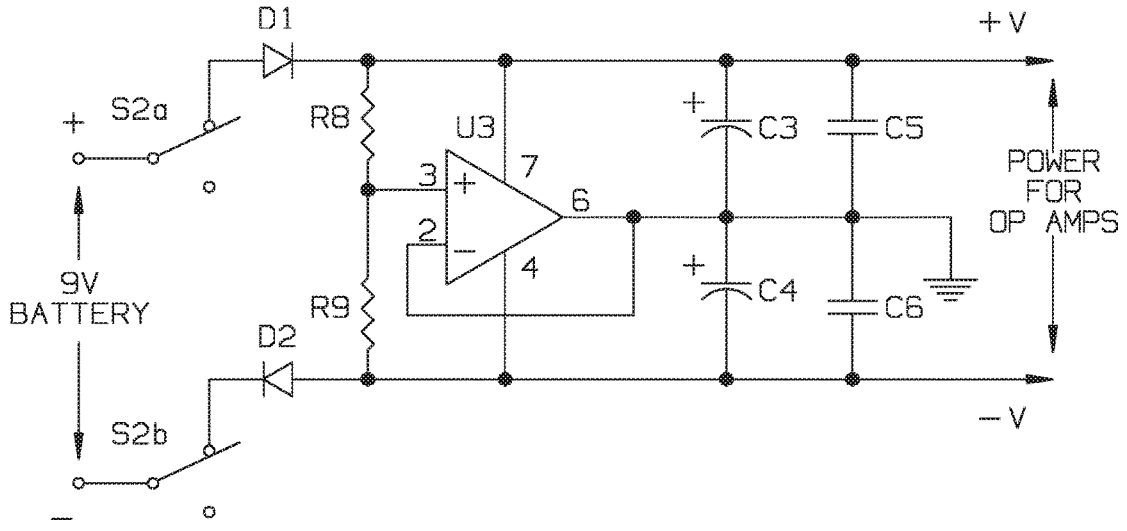
FIG. 7 is a schematic wiring diagram of power supply for operational amplifiers of the preamplifier of the humbucker pickup.

FIG. 7 illustrates a bipolar power supply circuit as one of a possible power supply for the preamplifier. Using an operational amplifier U3 with diodes D1, D2 the power supply may provide power by switching on/off the power by a 2-way toggle S2. Sometimes for switching on/off the power there may be used an output stereo jack on active guitars. Here, FIG. 7, the toggle S2 may be used as an additional toggle on a guitar. It allows for the guitar to use a standard output mono jack. Also, thanks to the bipolar circuit and the diodes D1 and D2, the toggle S2 can be with small clicks from switching on/off the power. At the same time, the diodes may protect the preamplifier from the incorrect reverse polarity from the battery. The diodes D1, D2 may be 1N4148, 1N4150 and the like. Resistors R8, R9 may be from approximately 200 k to approximately 240 k, oxide capacitors C3, C4 from approximately 6.8 uF to approximately 10 uF, capacitors C5, C6 from approximately 0.05 uF to approximately 0.1 uF. One or two preamplifiers on a guitar may require power supply from a single 9 Volt battery as it is in any active or digital guitar.

The preamplifier of the device may be mounted inside an electric guitar into the Volume-Tone section or directly inside the device like active EMG humbuckers manufactured by the company EMG Inc.

Guitar Equipment for Electric Guitar with the Humbucker Device

The term Guitar Equipment means usually that this equipment is intended for electric (or bass-electric) guitars. Other audio devices, amplifiers and loudspeakers for vocals and acoustic guitar, or standard Hr-Fi amplifiers etc., it is considered that such broadband equipment is not suitable for electric guitars. Indeed, the guitar equipment, guitar amplifiers and especially loudspeakers may have a specific narrow frequency range up to 5000-6000 Hz or even less. In particular, this helps to disguise flaws of conventional guitar pickups, for example, the losses and the distortions of the conventional humbucker 10 from 3000 Hz and above. In the described above test with the three electric guitars, so, there was implied the use of such guitar equipment. But as mentioned, using some other equipment is also possible for guitar with the humbucker device. And if to use in the said test the amplifiers and loudspeakers intended for acoustic guitar (or vocals) or some Hi-Fi preamplifier, it can be found again that electric guitar with the device (in the active mode) sounds also well with this broadband equipment. That also confirms the absence of any noticeable distortion for the humbucker device in the range up to 10-12 kHz.

However, in the absence of distortions in such big range dividing equipment into parts as for acoustic guitar and electric becomes quite arbitrary. In other words, electric guitar with the humbucker device may become as a universal musical instrument not requiring the special guitar equipment. Besides the guitar equipment, to get a good guitar tone, for example, if a broadband loudspeaker, it may be sufficient to have an amplifier with the 3-5-bands equalizer. And with some loudspeakers even usual Hi-Fi preamplifier and amplifier will be enough. Herewith, unlike acoustic guitar the electric guitar will not require microphone and microphone preamplifier.

Also, guitar with the device has one good property. At the wide choice of the equipment where guitar and the device may be used (given also the active mode), the device provides for guitar steady tonal properties and they are much more predictable than with conventional pickups. For guitars with conventional pickups here is a certain problem. When standard active pickups, the guitar tone is steady, but as is sometimes said, a stable "no brisk" because with a weak initial signal (weak magnets, a small number of windings) such pickups poorly transmit the individual characteristics of guitars and guitar playing. In turn, conventional passive pickups with a large number of windings can do that well. But here in the passive mode the electric guitar signal is too dependent on various factors including the length of the guitar cable. And the guitar tone is too dependent on the guitar equipment presented now by a large number of models and versions of amplifiers and loudspeakers with the individual and specific frequency range. Most of guitarists eventually prefer the passive pickups due to their sufficiently big signal from the coils, thus to better express the style and manner of play. But because of a big diversity in pickups, guitars and the guitar equipment, to catch a good guitar tone it is quite a difficult task.

For electric guitars with the humbucker device, in the absence of the described pickup-flaw of conventional humbuckers, the task to catch a good tone is greatly simplified thanks to the active mode using a differential amplifier, in other words, thanks to the good compatibility of this mode and the device with magnets of any big force. Such fortunate combination and compatibility with any magnets and conventional coils provide the minimum dependence on the equipment and a steady good tone for any guitar. This is a certain achievement. Currently, guitar players spend a lot of time to find a successful combination between their guitars, pickups and the guitar equipment. A known phenomenon GAS (Guitar Acquisition Syndrome), when having replaced some guitars and amplifiers, guitar players again buy after a while new guitars and the equipment, and professional guitarists take with themselves on a concert sometimes up to 10-15 different guitars including the acoustic.

Recording electric guitar and processing can also become simpler thanks to the humbucker device as an aid to technologies of record by computer. Generally speaking, the search for a good guitar tone has considerably intensified with the advent of computers. Earlier, guitarists had a wide choice of the guitar equipment at record studios and to find a good guitar sound it was not a big problem. Now, record and processing are to a great extent carried out at home studios on computers directly by guitarists, professional and usual players. Given that it is difficult to keep and to use at home the traditional sets of amplifiers and loudspeaker cabinets, the problem to find a good guitar sound has become particularly urgent.

In turn, manufacturers of audio equipment began to introduce in their devices (including computer audio cards) an additional Hi-Z (high-impedance) input for electric guitar. It provides in record a guitar signal without losses in the high and medium frequencies. However, these devices are not able to hide or disguise the flaws of conventional pickups and cannot compete against the rich studio equipment. In this regard, some studios offer an unusual way, so-called reamp method for recording electric guitar. By the reamp method, guitar players record their guitars in a comfortable home environment using their computers and the said appropriate Hi-Z devices. Further also on computers, they mount guitar tracks at their discretion, and then give the tracks (possibly via the Internet) to a professional studio. A studio engineer passes the signal from the tracks through a guitar amplifier and a loudspeaker with microphones etc., and finally, a new guitar track gets the appropriate tonal coloring. This method helps somewhat to approach to the traditional saturated studio-sound of guitar and due to the convenience it gained some distribution.

With the humbucker device the described reamp method, likely, may lose its meaning, and the described devices (with the Hi-Z input) are not needed when the active mode is used. The principal difference is that for the device it is not required to hide or mask any losses or distortions in its output signal. Also, it is not required a tonal coloring or harmonic saturation by effect boxes. The record process may require an ordinary preamplifier or a 3-5-bands equalizer as in a live play, but not necessarily a special guitar preamplifier or other guitar equipment. Perhaps, for some heavy musical styles the traditional guitar equipment will remain preferable, but that will not be as the general rule. The mentioned differential amplifier is used in a balanced input mode. Besides signal doubling and hum-canceling, this mode is known for one more feature to improve the sound, to do it more voluminous and with high resolution in fine details. This feature is well-known to manufacturers of High-End and studio devices. But to make the balanced mode, it is a quite difficult technical task and such devices are expensive. For two-coil pickups this task becomes much easier. And in the absence of the pickup-flaw the humbucker and the balanced mode give fine opportunities for electric guitars both in live performance and recording.

The Alternate Embodiment with the Plate

Though the exemplary and the alternate embodiments of the present invention give similar tones in the guitar sound and both tones equally beautiful, it may be useful for an electric guitar when at least one of its pickups is of the alternative version of the present invention with the steel plate 20, as shown in FIGS. 4A, 4B. This may be due to a known defect in the guitar sound arising from mixing the two signals from two conventional humbuckers on a guitar similar to the humbucker 10 of FIG. 1 when in the guitar output there is a mixed signal. At the time of switching on of both humbuckers 10, a mixed mode, this defect may manifest as an obvious loss of the brightness and the clarity in the sound, a characteristic sharp failure in the middle frequencies in the mixed mode. This occurs because of accumulating (doubling) the flaw from the two conventional humbuckers. I.e., in the mixed mode frequency losses and distortions in the guitar sound become even more noticeable. In practice, when both conventional humbuckers 10 are switched on, guitar players are often forced to do an additional adjustment by means of the guitar potentiometers to catch a good sound, and some players may not use the mixed mode. In the case when at least one of two humbuckers on a guitar is of the alternative version, with the plate 20, the said accumulation arises in a less degree and the described sound defect is imperceptible or at least inconsiderable.

The plate 20 may be inserted between the attracted magnets 1, 2 separating them throughout all their length, FIG. 4A. For the most useful effect the plate 20 must extend to the guitar strings 18 at the same distance as the pole pieces 7, 8. The plate 20 may act as a shield against the undesirable wide magnetic field 9, shown in FIG. 4B. Also, the plate 20 may act as a third auxiliary pole piece inside the interval D. However, a magnetic force of this plate 20 disposed between the two attracted magnets 1, 2 is a very weak in contrast to magnetic forces of the pole pieces 7, 8. Being a weak pole, the plate 20 cannot affect the string vibrations and does not affect the useful magnetic fields 3, 4. However, the plate 20 can additionally weaken remains of the unwanted wide magnetic field 9 around the string 18, FIG. 4B, if the plate 20 extends also close to the string as the pole pieces 7 and 8. The useful effect of the plate, as an additive in high-middle, can be felt in the clean guitar sound, in particular, with the use of wideband audio equipment.

So, the accumulation of losses, distortions may be imperceptible in the mixed mode when with two pickups at least one of them is the humbucker pickup with the plate 20. Therefore, in certain embodiments, to avoid an accumulation, the device of FIG. 4B may be used together with a conventional humbucker 10 of FIG. 1B on one guitar and be installed in any location Neck or Bridge. In playing by means of one pickup of FIG. 4B, the benefit from the plate 20 is manifested as some increase in brightness of guitar tone. This is a natural bright tone that cannot be obtained with equalizers or filters. As mentioned, it is especially noticeable with clean sound without distortion effects. If the plate 20 is 3-4 mm lower than the pole pieces 7, 8 its useful effect will quickly decrease. Therefore the plate and the pole pieces must be the same height.

Though a more interesting benefit may be achieved when the two various embodiments of the present invention are used on one guitar, especially when both humbucker devices work in the active mode with their respective preamplifiers. Here, the blended sound may turn out as a new guitar sound with its own enriched tone that appears at once at the time of switching to the blended sound without any additional adjustment of guitar potentiometers. In this regard, the two devices of the various embodiments (one of them with the plate 20) may be useful as a kit-pair of the devices for two-humbucker guitars.

Another interesting benefit from the at least two various embodiments of the present invention may be achieved in electric guitars intended for three pickups, in particular, three humbuckers. Now three-humbucker guitars are even less spread on the market than two-humbucker ones because of the said defect in the guitar sound with the mixed mode. The defect is increased with three conventional humbuckers 10 on guitar, and the degradation of the guitar sound becomes even more noticeable. Therefore, the mixed mode from three conventional humbuckers 10 is usually not used. A third conventional humbucker 10 in those three-humbucker guitars is positioned in a Middle location between the Neck and the Bridge humbuckers. And in the mixed mode it is connected alternatively either to the Neck humbucker or to the Bridge, or other variants, but, as a rule, not all three humbuckers together.

Generally, a characteristic feature of the mixed mode is the fact that with the addition of each of the following conventional humbuckers 10, the guitar sound may steadily be degraded. In turn, for the humbuckers of the present invention, the tonal properties in mixed mode may change, but not to be worse. And under certain conditions the electric guitar sound may be approaching to the sound of an acoustic guitar. I.e., the benefit for the sound from the different pickup-positions may be fuller and all three devices may be used for mixing.

The described 2-magnets system can help to reduce too big variety in guitar pickups which include magnets of different materials and different force. Today such magnets (alnico 2, alnico 5, ceramic etc.) are used to get individual tonal properties for the pickups. For the humbucker device with the 2-magnets system the magnet material do not really matter, and the magnets may be of any big force.

Other Alternate Embodiments

The effect of the invention may be the same with a single polar power supply for operational amplifiers. There may be other manners of balanced connection between the coils of the humbucker and the preamplifier, in particular, a balanced connection where each coil by means of its two ends (without connection with the ground) is connected to the two inputs of its own differential amplifier. However in this case the number of operational amplifiers is required twice more. Also, in an alternate embodiment an additional good guitar sound may be obtained if the coils of the device are connected together in the usual humbucker manner and connected only to one of the inputs, and the second input is grounded.

Figure 8:
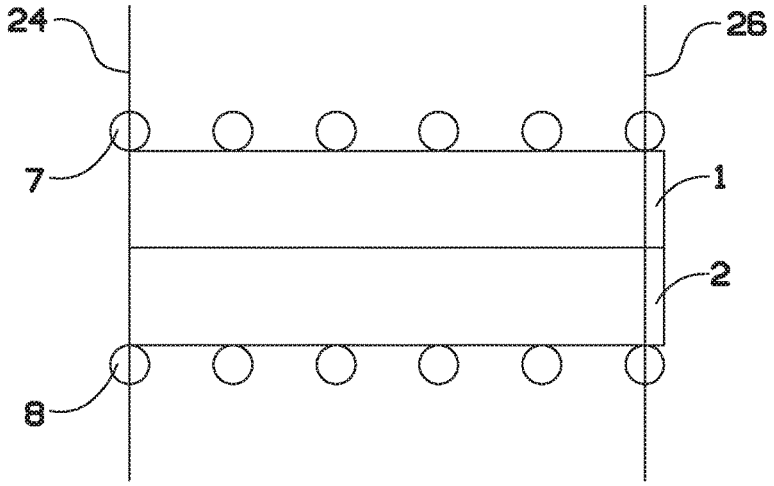
FIG. 8 illustrates a recommended disposition of magnets inside the humbucker pickup relative to the pole pieces associated with the sixth string for a case of the magnets of big force.

For fans of pickups with the increased number of windings, of about 9000 and more, a similar sound may be obtained by means of the device and coils L1, L2 also with an increased number of windings (from approximately 5000 and more for each coil). The device may not repeat fully a single-coil pickup 14 in sound because it picks up the string vibrations at the two points, however thanks to this, its tone may be even more beautiful and saturated. In rare case with wideband equipment, a small excess of low frequencies may be possible from the sixth string 24 of the guitar. To avoid this, FIG. 8 illustrates one of the possible disposition of the two magnets 1, 2 inside the device relative to pole pieces pertaining to the sixth string 24. I.e., the length of the sides of both magnets 1, 2 may be shortened. Such disposition is not typical and not required for the device, but it can slightly reduce the low frequencies from the sixth string in the case of large force magnets.

There are many electric guitars made of expensive types of wood. Practical use of the device has shown that cheap guitars made of cheap wood and even guitars not made of wood, for example, the pressed cardboard or plastic and the like, may also have a quality sound. The difference in the sound between expensive guitars made of expensive wood and cheap guitars of cheap wood becomes much less if these guitars have the invention.

It should be understood, of course, that the foregoing relates to exemplary embodiments of the invention and that modifications may be made without departing from the spirit and scope of the invention as set forth in the following claims.

What is claimed is:

1. A two-magnet humbucker pickup device for active and passive guitars with ferromagnetic strings comprising: a first magnet and a second magnet positioned adjacent the first magnet, each of which is in the form of an elongated bar of a rectangular cross-section with opposed longitudinal surfaces constituting pole faces, wherein opposite pole faces of the first magnet and the second magnet face each other and are internal magnetic poles of the magnets, accordingly other two opposite pole faces of the magnets are as an outer pole of the first magnet and an outer pole of the second magnet; a first set of ferrous pole pieces positioned along the outer pole of the first magnet and a second set of ferrous pole pieces positioned along the outer pole of the second magnet, wherein each pair of pole pieces, one pole piece from each of the sets having induced magnetic poles, extends to the corresponding string and creates two narrow magnetic fields applied to this string, wherein in the interval between the two pole pieces of said pair near the same string, there is a third wide magnetic field, which thanks to the two magnets and their internal magnetic poles is distorted and is weaker than the analogous wide magnetic field in prior art conventional humbuckers with a single magnet of the same width as the total width of the two magnets of the device, and wherein said two-magnet humbucker pickup device provides, thereby, more free string vibrations in a guitar, improved string signals and tonal properties of the humbucker and the guitar.

2. The humbucker pickup device in claim 1, wherein the first and second magnets may be made of any permanent magnet material of any conventional magnetic force, but the magnets must be equal in their sizes and magnetic forces.

3. The humbucker pickup device in claim 1 further comprising a matched pair of elongated coil assemblies placed closely in parallel, wherein pole pieces of the first set extend through one of said coil assemblies, and pole pieces of the second set respectively through the other coil, wherein two of the four end wires of said coils, one wire from each of the coils, are electrically connected to ground terminal of the device such that said coils are electrically in same polarity, and two other end wires of the coils are as two output ends of humbucker pickup means including said magnets, coils and pole pieces for converting the string signals into electrical pickup signals.

4. The humbucker pickup device of claim 3 further comprising a differential amplifier having inverting and noninverting input terminals, which provides a balanced input mode by the respective connection in which one of the output ends of said humbucker pickup means is connected to one of said terminals, accordingly the second output end to the other terminal to get noise immunity for the device, wherein for said coils electrically connected in same polarity the differential amplifier provides canceling external in-phase noise signals, while due to opposite magnetic polarities of pole pieces pertaining to the different coils, the music signals magnetically created in the coils are added providing, thereby, a full-fledged noiseless output device signal.

5. The humbucker pickup device of claim 4, wherein said differential amplifier is an improved differential amplifier built from two or three operational amplifiers having high input impedance that allows the humbucker device to use conventional cods including high impedance coils with a big number of turns similar to coils in prior art passive humbucker or single-coil pickups, and wherein thanks to said improved string signals, any additional filters or equalizers inside pickup or guitar body, similar to those used in prior art active pickups, do not required.

6. A method for improving the narrowing of the magnetic field applied to the ferromagnetic strings from a two-magnet humbucker pickup device comprising: placing at least one humbucker pickup device underneath the strings on a stringed instrument, wherein said humbucker pickup device comprises a first magnet and a second magnet positioned adjacent the first magnet, each of which is in the form of an elongated bar of a rectangular cross-section with opposed longitudinal surfaces constituting pole faces, wherein opposite pole surfaces of the first magnet and the second magnet face each other and are internal magnetic poles of the magnets, accordingly other two opposite pole faces of the magnets are as an outer pole of the first magnet and an outer pole of the second magnet; a first set of ferrous pole pieces positioned along the outer pole of the first magnet and a second set of ferrous pole, pieces positioned along the outer pole of the second magnet, wherein each pair of pole pieces, one pole piece from each of the sets having induced magnetic poles, extends to the corresponding string and creates two narrow magnetic fields applied to this string, wherein in the interval between the two pole pieces of said pair near the same string, there is a third wide magnetic field, which thanks to the two magnets and their internal magnetic poles is distorted and is weaker than the analogous wide magnetic field in prior art conventional humbuckers with a single magnet of the same width as the total width of the two magnets of the device, and wherein said two-magnet humbucker pickup device provides, thereby, more free string vibrations and improved string signals; a matched pair of elongated coil assemblies placed closely in parallel, each of which has one of said sets of pole pieces extending through the coil assembly; and generating electromagnetic signals by having the two narrow magnetic fields interacting with the string.

7. The method of claim 6, wherein the first and second magnets may be made of any permanent magnet material of any conventional magnetic force, but the magnets must be equal in their sizes and magnetic forces.

8. The method of claim 6, wherein the at least one humbucker pickup device further comprises a differential amplifier having inverting and noninverting input terminals, which provides a balanced input mode by the respective connection of its terminals with said two coils to get noise immunity for the device, wherein for said coils electrically connected in same polarity the differential amplifier provides canceling external in-phase noise signals, while due to opposite magnetic polarities of pole pieces pertaining to the different coils, the music signals magnetically created in the coils are added providing, thereby, a full-fledged noiseless output device signal.

* * * * *